US008723083B2

(12) United States Patent
Kawata et al.

(10) Patent No.: US 8,723,083 B2
(45) Date of Patent: May 13, 2014

(54) COOKING DEVICE WITH ARC-SHAPED ELECTRODES USED FOR BOIL-OVER DETECTION

(75) Inventors: Kohei Kawata, Hyogo (JP); Hidekazu Suzuki, Hyogo (JP); Kenzo Usui, Hyogo (JP); Taihei Oguri, Hyogo (JP); Hiroyuki Katsube, Hyogo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/394,280

(22) PCT Filed: Jan. 28, 2011

(86) PCT No.: PCT/JP2011/000490

§ 371 (c)(1),
(2), (4) Date: Mar. 5, 2012

(87) PCT Pub. No.: WO2011/093099

PCT Pub. Date: Aug. 4, 2011

(65) Prior Publication Data

US 2012/0160820 A1 Jun. 28, 2012

(30) Foreign Application Priority Data

Jan. 29, 2010 (JP) ..... 2010-018168
Jan. 29, 2010 (JP) ..... 2010-018170
Jan. 29, 2010 (JP) ..... 2010-018171
Jan. 29, 2010 (JP) ..... 2010-018172
Jan. 29, 2010 (JP) ..... 2010-018173

(51) Int. Cl.
*H05B 3/68* (2006.01)

(52) U.S. Cl.
USPC ..... 219/209; 219/413; 219/494; 219/620

(58) Field of Classification Search
USPC ..... 219/209, 780, 600, 618, 620, 622, 494, 219/413
See application file for complete search history.

(56) References Cited

U.S. PATENT DOCUMENTS 4,446,350 A 5/1984 Mizukawa et al.
2009/0303201 A1 12/2009 Isoda et al.
2010/0096382 A1 4/2010 Sakakibara et al.
2011/0309069 A1* 12/2011 Fujinami et al. ..... 219/622

FOREIGN PATENT DOCUMENTS

EP 0 429 120 A2 5/1991
EP 2 117 282 A1 11/2009
JP 58-128691 A 8/1983

(Continued)

OTHER PUBLICATIONS

Machine translation of JP2008-159494, accessed Apr. 21, 2013.*

(Continued)

*Primary Examiner* — Dana Ross
*Assistant Examiner* — John Wasaff
(74) *Attorney, Agent, or Firm* — Brinks Gilson & Lione

(57) ABSTRACT

The cooking device includes a top plate on which containers are to be placed, heating devices provided under the top plate, electrodes provided on a lower surface of the top plate, capacitance detection devices for detecting changes in capacitance of the electrodes, and a boil over determination device for determining a liquid boiled over from the containers on the basis of the changes in capacitance detected by the capacitance detection devices in heating operations of the heating devices. The electrodes have a plurality of arc-shaped detection parts provided along periphery of each of the heating devices.

6 Claims, 5 Drawing Sheets

(56) References Cited

FOREIGN PATENT DOCUMENTS

| | | | |
|---|---|---|---|
| JP | 61-243690 | A | 10/1986 |
| JP | 03-119683 | A | 5/1991 |
| JP | 2001-297864 | A | 10/2001 |
| JP | 2003-224459 | A | 8/2003 |
| JP | 2004-171855 | A | 6/2004 |
| JP | 2005-166392 | A | 6/2005 |
| JP | 2005-257202 | A | 9/2005 |
| JP | 2007-220388 | A | 8/2007 |
| JP | 2008-159494 | A | 7/2008 |
| JP | 2009-099365 | A | 5/2009 |
| JP | 2009-218106 | A | 9/2009 |
| WO | WO 2008/084829 | A1 | 7/2008 |
| WO | WO 2008/090887 | A1 | 7/2008 |
| WO | WO 2010/079583 | A1 | 7/2010 |

OTHER PUBLICATIONS

International Preliminary Report on Patentability for International Application No. PCT/JP2011/000490, dated Sep. 18, 2012, 8 pages.
International Search Report for International Application No. PCT/JP2011/000490, dated May 17, 2011, 4 pages.
Office Action in co-pending U.S. Appl. No. 13/394,366, dated Jun. 28, 2012, 15 pages.
International Search Report for International Application No. PCT/JP2011/000491, dated May 10, 2011, 7 pages.
International Search Report for International Application No. PCT/JP2011/000493, dated May 17, 2011, 4 pages.
International Preliminary Report on Patentability for International Application No. PCT/JP2011/000491, dated Sep. 18, 2012, 9 pages.
International Preliminary Report on Patentability for International Application No. PCT/JP2011/000493, dated Sep. 18, 2012, 8 pages.
Office Action from co-pending U.S. Appl. No. 13/394,366, dated Mar. 12, 2013, 8 pages.
Supplementary European Search Report in corresponding European Application No. 11 73 6814, dated Jan. 7, 2014, 6 pages.
Extended European Search Report for European Application No. 11736815.9, dated Jan. 7, 2014, 6 pages.
Extended European Search Report for European Application No. 11736816.7, dated Jan. 7, 2014, 6 pages.
Advisory Action in co-pending U.S. Appl. No. 13/394,366, dates Dec. 4, 2013, 5 pages.
Office action from Chinese Application No. 201180003698.7, dated Feb. 20, 2014, 9 pages.
Office Action from Chinese Application No. 201180003697.2, dated Mar. 14, 2014, 8 pages.
Office Action from Chinese Application No. 201180003696.8, dated Mar. 25, 2014, 9 pages.

* cited by examiner

COOKING DEVICE WITH ARC-SHAPED ELECTRODES USED FOR BOIL-OVER DETECTION

-CROSS-REFERENCE TO RELATED APPLICATIONS

This application is a 371 application of PCT/JP2011/000490 having an international filing date of Jan. 28, 2011, which claims priority to JP2010-018173 filed Jan. 29, 2010, JP2010-018172 filed Jan. 29, 2010, JP2010-018171 filed on Jan. 29, 2010, JP2010-018170 filed Jan. 29, 2010 and JP2010-018168 filed Jan. 29, 2010, the entire contents of which are incorporated herein by reference.

TECHNICAL FIELD

The present invention relates to a cooking device for household use.

BACKGROUND ART

Conventionally, there has been a type of cooking device having electrodes on a top plate thereof on which a container such as a pot is placed, as disclosed in Patent Literatures 1 and 2. In the cooking device disclosed in Patent Literature 1, electrodes, which are formed as touch keys that make use of changes in electrostatic capacitance of the electrodes, are provided on a portion of a top plate in front of the container (on the front side of the cooking device). On the cooking device disclosed in Patent Literature 2 are pasted electrodes for detecting liquid boiled over from a container onto a top plate.

PTL1: JP 2007-220388 A

PTL2: JP S61-243690 A

SUMMARY OF THE INVENTION

Technical Problem

With regard to the cooking device disclosed in Patent Literature 1, however, it is impossible to discriminate between a state in which the liquid boiled over from the container is deposited onto the touch keys and a state in which a user is operating the keys by touching them with his/her fingers. In addition, only the liquid boiled over onto the front side of the container can be detected by the electrodes provided only on the portion of the top plate in front of the container (on the front side of the cooking device), while the liquid boiled over in other directions from the container cannot be detected by the electrodes.

The cooking device disclosed in Patent Literature 2 has the electrodes formed on an upper surface of the top plate and is configured so that the liquid boiled over is detected by detection of a decrease in the value of resistance between two electrodes that is caused by a short-circuit between both the electrodes through the liquid boiled over from the container. Accordingly, there is a fear that damage to the electrodes may decrease the accuracy of detecting the liquid boiled over. Therefore, it is inconvenient to use such a cooking device.

An object of the invention is to provide a cooking device which is capable of accurately detecting a liquid boiled over from a container in various directions and which is easy to use.

Solution to Problem

In order to achieve the above object, the present invention has the following constitutions.

According to a first aspect of the present invention, there is provided A cooking device comprising:

a top plate on which a container are to be placed;

a heating device provided under the top plate;

a plurality of electrodes provided on a lower surface of the top plate;

a capacitance detection device for detecting changes in capacitance of the electrodes; and a boil over determination device for determining that liquid is boiled over from the container on the basis of the changes in capacitance detected by the capacitance detection device in heating operation of the heating device, wherein the plurality of electrodes comprising a plurality of arc-shaped detection parts provided along periphery of the heating device.

According to a second aspect of the present invention, there is provided the cooking device according to the first aspect of the present invention, wherein the plurality of arc-shaped detection parts are positioned on a circumference of one circle having a center that generally coincides with a center of the heating device as seen looking from above.

According to a third aspect of the present invention, there is provided the cooking device according to the second aspect of the present invention, wherein at least one arc-shaped detection part is provided on each of a front side and a rear side of a parallel direction center line that extends in parallel with a front face of the cooking device and that passes through the center of the heating device.

According to a fourth aspect of the present invention, there is provided the cooking device according to the second aspect of the present invention, comprising a first arc-shaped detection part provided on the front side of the parallel direction center line, a second arc-shaped detection part provided on the rear side of the parallel direction center line, and a third arc-shaped detection part provided so as to intersect with the parallel direction center line.

According to a fifth aspect of the present invention, there is provided the cooking device according to the fourth aspect of the present invention, comprising the plurality of heating devices, wherein the third detection part provided for each of the heating devices is provided on only a side nearer to the other heating device.

According to a sixth aspect of the present invention, there is provided the cooking device according to the first aspect of the present invention, comprising a heating device control system that stops a heating operation of the heating device or reduces heating output of the heating device once the boil over determination device determines that the liquid is boiled over from the container.

Advantageous Effects of Invention

According to this invention, the cooking device can be provided that is capable of detecting a liquid boiled over from a container in various directions and that is easy to use.

BRIEF DESCRIPTION OF THE DRAWINGS

The above aspects and features of the present invention will become more apparent from the following description of preferred embodiments thereof with reference to the accompanying drawings, and wherein.

DETAILED DESCRIPTION OF THE PREFERRED EMBODIMENTS

Figure 1:
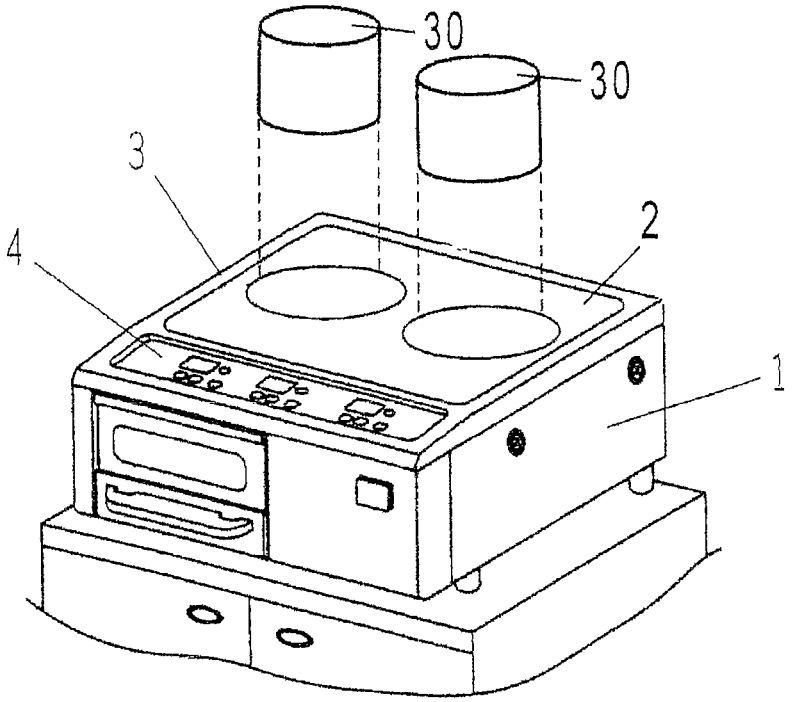
FIG. 1 is a perspective view of a cooking device according to an embodiment of the invention.

A first invention provides a cooking device comprising: a top plate on which a container are to be placed; a heating device provided under the top plate; a plurality of electrodes provided on a lower surface of the top plate; a capacitance detection device for detecting changes in capacitance of the electrodes; and a boil over determination device for determining that liquid is boiled over from the container on the basis of the changes in capacitance detected by the capacitance detection device in heating operation of the heating device, wherein the plurality of electrodes comprising a plurality of arc-shaped detection parts provided along periphery of the heating device.

According to the first invention, when the liquid boiled over from the container heated by the heating device is deposited on a portion of the top plate that is positioned over the detection part of an electrode, the capacitance of the detection part changes so as to increase or decrease. The boil over can be detected on the basis of the change in capacitance of the detection part, that is, on condition that the change is an increase or a decrease not less than a specified quantity. The plurality of detection parts are shaped like arcs provided along the periphery of the heating device, and thus the liquid boiled over from the container in directions in which the arc-shaped detection parts exist can be detected with uniform sensitivities. Besides, each of the plurality of arc-shaped detection parts has an electric resistance between both ends thereof lower than that of one detection part surrounding the heating device and thus facilitates detection of the change in capacitance of the detection part, i.e., ensures higher detection accuracy for the liquid boiled over. Furthermore, the detection parts are protected so as not to be in contact with the container placed on the top plate by being provided on the lower surface of the top plate, and thus resist being damaged. Thus there can be provided the cooking device that is capable of detecting the liquid boiled over from the container in various directions and that is easy to use.

In a second invention, the cooking device of the first invention is configured so that the plurality of arc-shaped detection parts are positioned on a circumference of one circle having a center that generally coincides with a center of the heating device as seen looking from above.

Thus it can be detected with uniform sensitivities that the liquid is boiled over, even if the liquid is boiled over from the container in various directions, provided that the container is placed so that a center of the container faces the center of the one circle. As a result, the accuracy of detecting the liquid boiled over is further improved.

In a third invention, the cooking device of the second invention is configured so that at least one arc-shaped detection part is provided on each of a front side and a rear side of a parallel direction center line that extends in parallel with a front face of the cooking device and that passes through the center of the heating device.

This increases the accuracy of detecting the boil over toward the front face side of the cooking device on which a user may exist while allowing detection of the boil over in other directions. As a result, the cooking device improved in ease of use can be provided.

In a fourth invention, the cooking device of the second invention further comprises a first arc-shaped detection part provided on the front side of the parallel direction center line, a second arc-shaped detection part provided on the rear side of the parallel direction center line, and a third arc-shaped detection part provided so as to intersect with the parallel direction center line.

Thus the accuracy of detecting the liquid boiled over from the container toward a lateral face side of the cooking device can be improved.

In a fifth invention, the cooking device of the fourth invention further comprises the plurality of heating devices, wherein the third detection part provided for each of the heating devices is provided on only a side nearer to the other heating device.

This suppresses the detection of liquid over from the container heated by one heating device by the detection parts provided for another heating device. That is, mis-detection of boil over can be suppressed, so that reliability of the cooking device is improved.

In a sixth invention, the cooking device of the first invention further comprises a heating device control system that stops a heating operation of the heating device or reduces heating output of the heating device once the boil over determination device determines that the liquid is boiled over from the container.

Thus the heating for the container is stopped or the heating output is reduced once the liquid boils over from the container and therefore safety of the cooking device is further improved.

Hereinbelow, embodiments of the present invention will be described with reference to the accompanying drawings. It is noted that the invention is not limited by the following embodiments.

FIG. 1 is a perspective view of a cooking device according to an embodiment of the invention. FIG. 1 shows the cooking device of induction heating type.

As shown in FIG. 1, the cooking device has a main body 1 and a top plate 2 which is provided on top of the main body 1 and on which containers 30 such as pots containing liquid are to be placed. The top plate 2 is made from material, such as high temperature resistance glass, that does not generate heat by electromagnetic induction and that has heat resistance and heat insulating property. On the top plate 2, patterns are printed, in addition to heating area display parts 2*a*, 2*b* for displaying heating areas, with use of material excellent in heat resistance, wear resistance and the like in order to improve designability.

A top frame 3 covers periphery of the top plate 2 and forms a part of a top surface of the cooking device. The top frame 3 is made from material, such as stainless and porcelain enamel steel plate, that sufficiently resists heat conducted from the liquid and the containers 30 through the top plate 2, that is good-looking as an external part, and that is resistant to corrosion.

Figure 2:
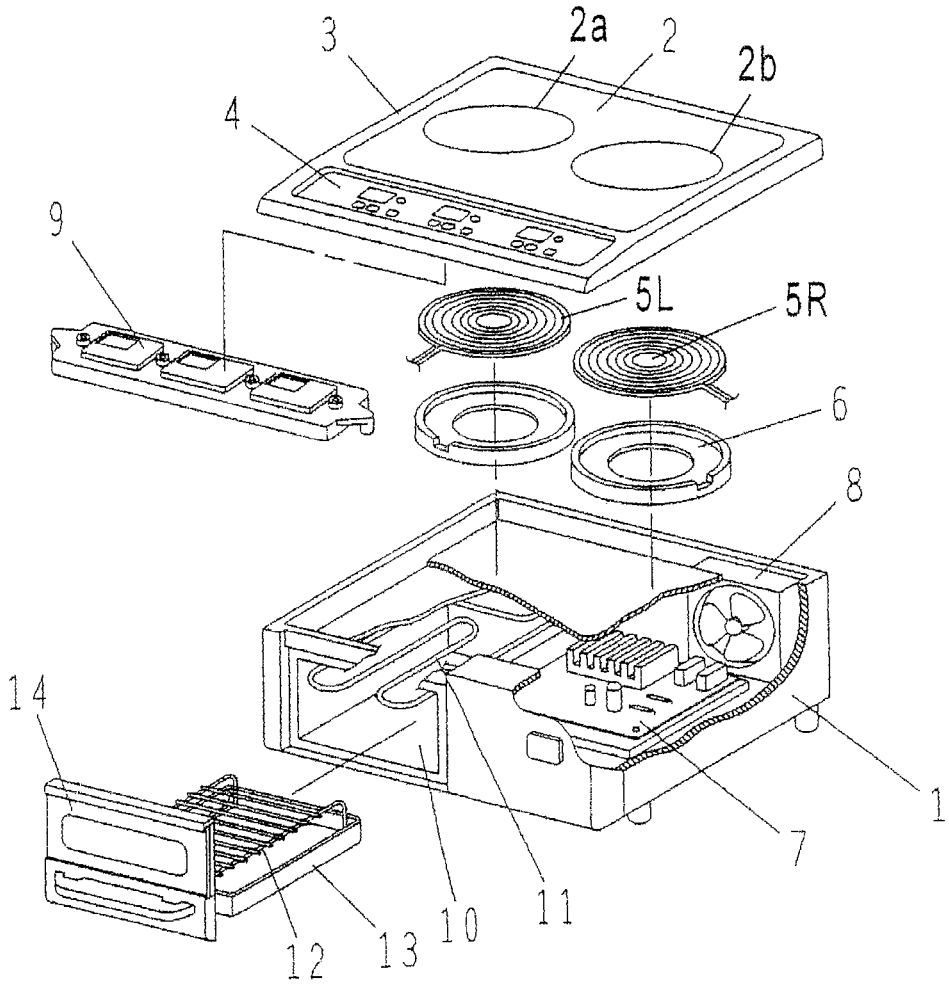
FIG. 2 is a perspective view showing inside of the cooking device shown in FIG. 1.

FIG. 2 is a perspective view showing inside of the cooking device shown in FIG. 1.

An operation unit 9 is provided under a top surface operation part 4 formed on the top frame 3. Under the top plate 2, a plurality of induction heating coils 5L, 5R are provided as heating devices forming heating sources and are arranged adjacent to each other on left and right sides as seen looking from a side of a front face 27 of the main body. The induction heating coils 5L, 5R are placed in coil cases 6 and are held in specified positions in the main body 1. The induction heating coils 5L, 5R are supplied with high-frequency electric power by a heating device control system 7 including semiconductor switching elements (not shown) and control circuits therefor. The induction heating coils 5L, 5R thereby carry out induction heating of the containers 30 placed on sites shown by the heating area display parts 2*a*, 2*b* on the top plate 2. The induction heating coils 5L, 5R and the heating device control system 7 are cooled by air blow from a cooling fan 8.

A grill cooking device 10 generally shaped like a box is provided in the main body 1. The grill cooking device 10 has a grill heater 11 inside for heating objects to be cooked in the grill cooking device 10. The grill cooking device 10 has a pan 13 having a detachable gridiron 12 on which the objects to be cooked are to be placed. The pan 13 is detachably mounted on a grill door 14 covering an opening of the grill cooking device 10. The pan 13 and the grill door 14 are configured so as to be integrally movable toward inside or outside of the grill cooking device 10.

Figure 3:
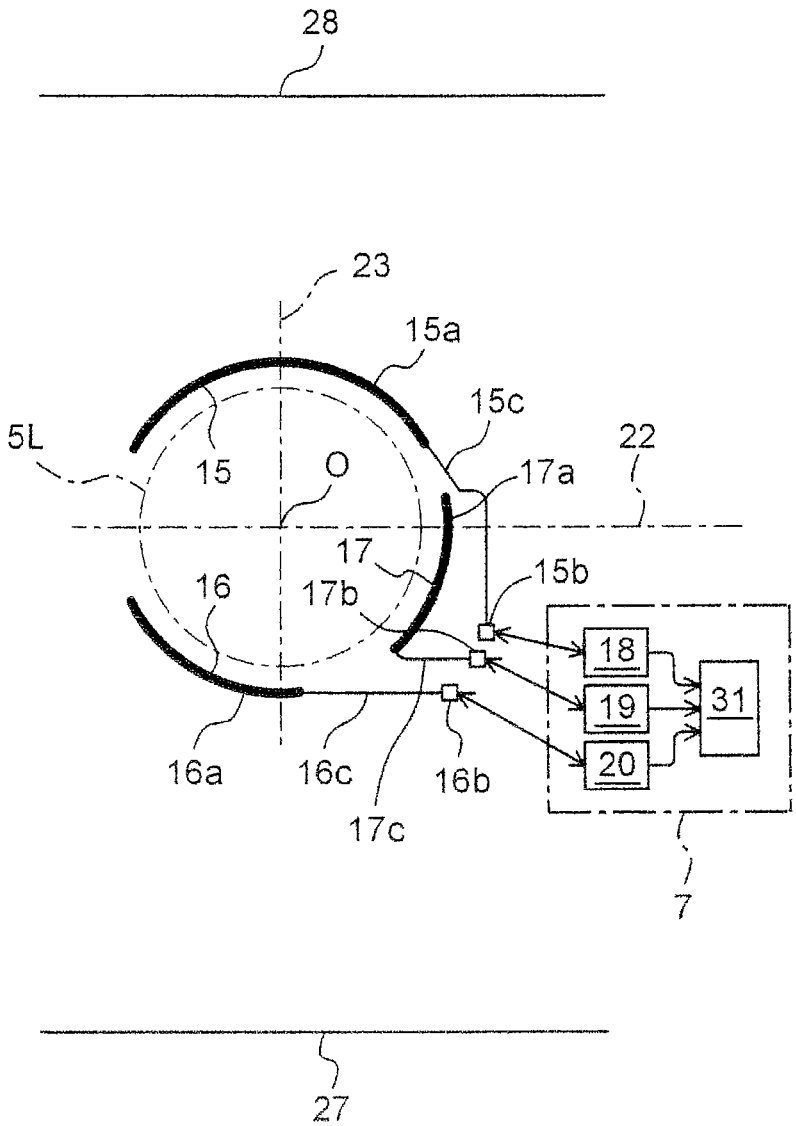
FIG. 3 is a diagram for illustrating a configuration of electrodes according to the embodiment of the invention.

A plurality of electrodes for detecting the liquid boiled over from the containers 30 are provided in vicinity of the plurality of induction heating coils 5L, 5R. FIG. 3 shows a first electrode 15, a second electrode 16, and a third electrode 17 that are provided corresponding to the induction heating coil 5L on the left side of the cooking device as seen looking from the front face 27 of the cooking device shown in FIGS. 1 and 2. Electrodes (not shown) similar to the first electrode 15, the second electrode 16, and the third electrode 17 are provided corresponding to the induction heating coil 5R on the right side of the cooking device as seen looking from the front face 27 so as to be symmetrical thereto with respect to an axis of symmetry 29 shown in FIG. 4 and perpendicular to the front face 27. Therefore, description will be given only on the first electrode 15, the second electrode 16, and the third electrode 17 that are provided corresponding to the induction heating coil 5L on the left side.

The first electrode 15, the second electrode 16, and the third electrode 17 are for detecting the liquid boiled over from the container 30 and are provided on a lower surface of the top plate 2. The electrodes 15, 16, and 17 may be provided by printing on the lower surface of the top plate 2 or by bonding of the electrodes on the lower surface of the top plate 2.

As shown in FIG. 3, the first electrode 15, the second electrode 16, and the third electrode 17 have a first detection part 15*a*, a second detection part 16*a*, and a third detection part 17*a*, respectively. The first detection part 15*a*, the second detection part 16*a*, and the third detection part 17*a* are in shape of arcs and are provided so as to surround the whole induction heating coil 5L with a radius larger than an outside diameter of the induction heating coil 5L, at a distance (e.g., 30 mm) from periphery of the induction heating coil 5L, and along the periphery of the induction heating coil 5L.

The first electrode 15 has a first connection part 15*b* that is a part through which a high-frequency voltage for detecting a change in capacitance of the first detection part 15*a* is supplied and a first interconnection part 15*c* that provides an electrical connection between the first connection part 15*b* and the first detection part 15*a*. A width of the first detection part 15*a* can be set at about 3 mm, for instance. A width of the first interconnection part 15*c* is preferably set smaller than the width of the first detection part 15*a* so as to prevent misdetection of boil over resulting from contact of a hand of a user with a portion of the top plate 2 over the part 15*c*. The width thereof can be set at about 1.5 mm. Similarly, the second electrode 16 has a second detection part 16*a*, a second connection part 16*b*, and a second interconnection part 16*c*, and the third electrode 17 has a third detection part 17*a*, a third connection part 17*b*, and a third interconnection part 17*c*. Provided in the main body 1 are capacitance detection devices 18, 19 and 20. Electrical connections are provided between the first connection part 15*b* and the capacitance detection device 18, between the second connection part 16*b* and the capacitance detection device 19, and between the third connection part 17*b* and the capacitance detection device 20. The electrical connections are attained by pressure and contact of end parts of connection terminals (not shown), provided on the capacitance detection devices 18, 19 and 20, with the first connection part 15*b*, the second connection part 16*b* and the third connection part 17*b*, respectively, for instance. In the heating device control system 7 is provided a boil over determination device 31 for determining that the liquid is boiling over from the container 30 on condition that quantities of change in capacitance detected by at least one of the capacitance detection devices 18, 19 and 20 exceed a specified quantity.

When the liquid boils over from the container 30, placed in accordance with the heating area display part 2*a* on the top plate 2 that is positioned over the induction heating coil 5L, onto parts of the top plate 2 that are positioned over the first detection part 15*a*, the second detection part 16*a*, and the third detection part 17*a*, a change occurs in capacitance of the first detection part 15*a* that is positioned under the portions of the top plate 2 onto which the liquid is boiled over. When at least one of the capacitance detection devices 18, 19 and 20 detects changes in capacitance by quantities exceeding the specified quantity, the boil over determination device 31 determines that the liquid is boiled over from the container 30 heated by the induction heating coil 5L. Thus the boil over can be detected.

In the embodiment, the liquid boiled over in various directions from the containers 30 heated by the induction heating coils 5L, 5R can be detected by the first, second and third electrodes 15, 16 and 17 having the plurality of first, second and third arc-shaped detection parts 15*a*, 16*a* and 17*a* provided along the periphery of the induction heating coils 5L, 5R.

The provision of the plurality of first, second and third arc-shaped detection parts 15*a*, 16*a* and 17*a* along the periphery of the induction heating coils 5L, 5R ensures higher detection accuracy for boil over than provision of electrodes having one continuous detection part for each of the heating devices 5L, 5R (e.g., than provision of electrodes having one annular detection part surrounding periphery of each induction heating coil). The reason is that the plurality of first, second and third arc-shaped detection parts 15*a*, 16*a* and 17*a* shorter than the one continuous annular electrode have lower electric resistances and thus help the capacitance detection devices to read changes in capacitance (improve the detection accuracy).

Besides, the first, second and third electrodes 15, 16 and 17 having the plurality of first, second and third arc-shaped detection parts 15*a*, 16*a* and 17*a* are protected so as not to be in contact with bottom surfaces of the containers 30 by being provided on the lower surface of the top plate 2 instead of being provided on an upper surface on which the containers 30 are to be placed, and thus have extremely lower probability of being damaged than electrodes that could be provided on the upper surface of the top plate 2.

Thus there can be provided the cooking device which is capable of detecting the liquid boiled over from the containers 30 in various directions and which is easy to use.

The embodiment described above is one embodiment of the invention and can be modified in various manners.

Figure 4:
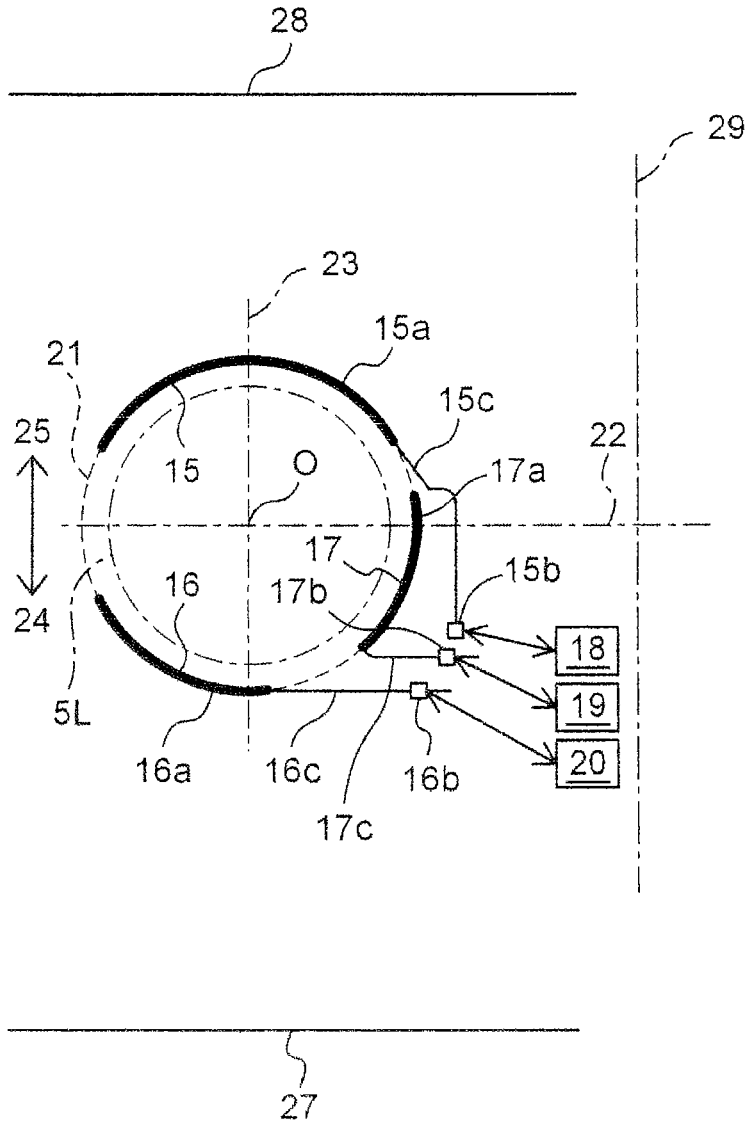
FIG. 4 is a diagram for further illustrating the configuration of the electrodes according to the embodiment of the invention.

As shown in FIG. 4, for instance, the first detection part 15*a*, the second detection part 16*a*, and the third detection part 17*a* may be arranged on a circumference of a circle 21 that has a center in generally the same position as a center O of the induction heating coil 5L as seen looking from above (the center O and a center of the heating area display part 2*a* are in the same position). In this arrangement, the liquid having boiled over from the container 30 in various directions can be detected with uniform sensitivities, provided that the container 30 is placed on the top plate 2 so that a center of the bottom surface of the container 30 coincides with a point of the top plate 2 corresponding to the center of the circle 21. This improves the accuracy of detecting the liquid having boiled over and the ease of use.

With regard to the first electrode 15 and the second electrode 16 shown in FIG. 4, for instance, at least one arc-shaped first detection part 15*a* and at least one arc-shaped second detection part 16*a* are preferably provided on the side of the front face 27 (in a direction of an arrow 24) and on a side of a rear face 28, that is, rear side (in a direction of an arrow 25) with respect to a parallel direction center line 22 that extends in parallel with the front face 27 of the cooking device and that passes through the center of the induction heating coil 5L. This increases the accuracy of detecting the liquid boiled over toward the side of the front face 27 of the cooking device in which a user may exist while allowing detection of the liquid boiled over in other directions. Thus there can be provided the cooking device that is of greater safety. Further, in order to increase the accuracy of detecting the liquid boiled over from the container 30 toward a direction of a lateral face of the cooking device, the third detection part 17*a* of the third electrode 17 is preferably provided such that it intersects with the parallel direction center line 22, as shown in FIG. 4, for instance.

Figure 5:
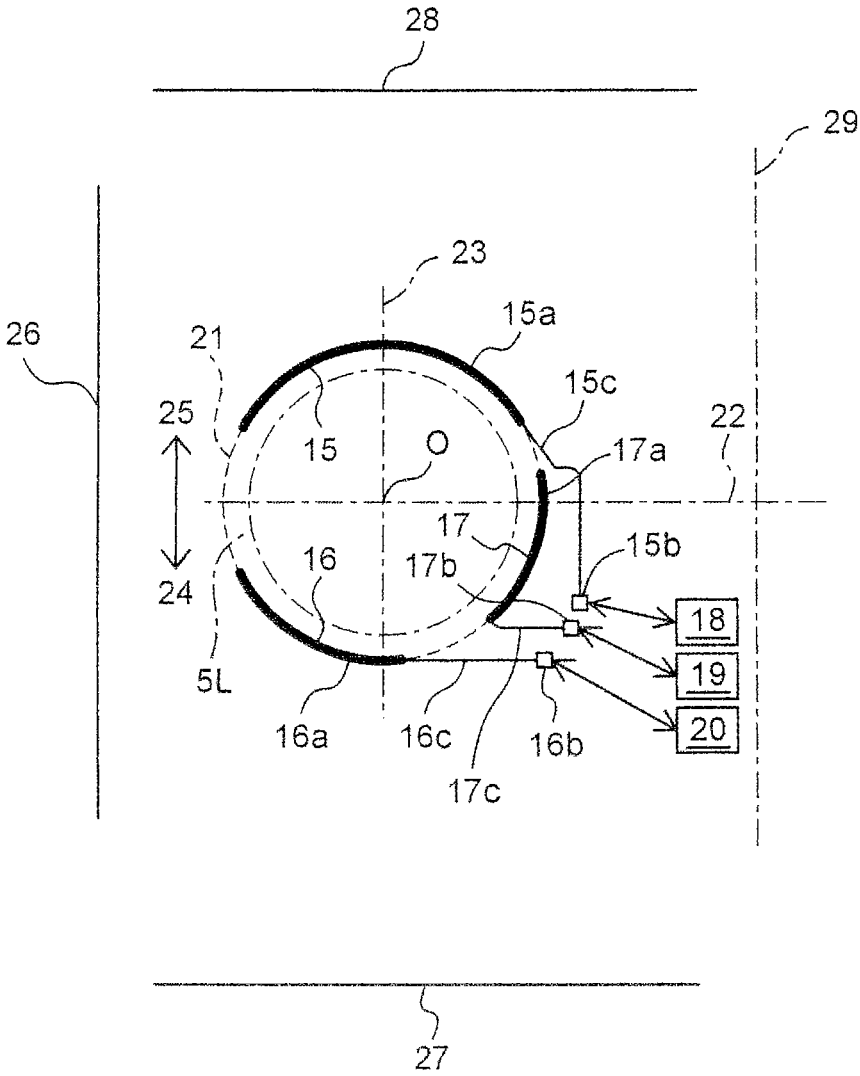
FIG. 5 is a diagram for further additionally illustrating the configuration of the electrodes according to the embodiment of the invention.

In the cooking device in which the plurality of induction heating coils 5L, 5R are provided as shown in FIGS. 1 and 2, the third detection part 17*a*, which intersects with the parallel direction center line 22 and is provided for the induction heating coil 5L, is preferably provided so that at least a portion thereof resides on a side of the induction heating coil 5L farther from a lateral surface 26 of the main body 1, that is, the side closer to the other induction heating coil 5R, as shown in FIG. 5.

In the arrangement in which the two induction heating coils 5L, 5R are placed on the parallel direction center line 22 shown in FIG. 5 (only one induction heating coil 5L is shown), for instance, the third detection part 17*a*, which intersects with the parallel direction center line 22 is provided on the side of the induction heating coil 5L nearer to the other induction heating coil 5R with respect to a perpendicular direction center line 23 that passes through the center O of the induction heating coil 5L and that is orthogonal to the parallel direction center line 22.

This suppresses detection of liquid boiled over from the containers 30 being heated by the induction heating coil 5L by the detection parts provided for the other adjacent induction heating coil 5R. That is, mis-detection of the boil over can be suppressed, so that the ease of use and the reliability of the cooking device are improved.

Furthermore, when the boil over determination device 31 determines that the liquid is boiled over from the container 30, the heating device control system 7 may be configured so as to stop a heating operation of the induction heating coil heating the container 30 from which the liquid is boiled over or to reduce heating output of the induction heating coil 5L to such a degree that the boil over may be reduced. This improves the ease of use of the cooking device.

In addition, there do not have to be three sets composed of the first, second and third arc-shaped detection parts 15*a*, 16*a* and 17*a* and the capacitance detection devices 18, 19 and 20, and there have only to be not less than two sets. Such a configuration can be used to more accurately detect the liquid boiled over from the container.

When the container 30 is placed by a user so as to deviate from the heating area display part 2*a* on the top plate 2 so that a portion of the container 30 is placed over any of the first detection part 15*a*, the second detection part 16*a*, and the third detection part 17*a*, for instance, the capacitance of any one of the first detection part 15*a*, the second detection part 16*a*, and the third detection part 17*a* changes to increase, and the capacitances of other detection parts change to decrease, for instance. Under this condition, magnetic coupling between the induction heating coil 5L and the container 30 simultaneously changes. On condition that the change in the magnetic coupling between the induction heating coil 5L and the container 30 and the changes in capacitance of the first detection part 15*a*, the second detection part 16*a*, and the third detection part 17*a* simultaneously take place, accordingly, it can be determined that there is no boil over and that the container 30 has been shifted by the user. Contact of a user with the container 30 can be detected on basis of simultaneous changes greater than a specified value in capacitances of the first detection part 15*a*, the second detection part 16*a*, and the third detection part 17*a* in a shorter period in comparison with the changes caused by boil over. Besides, contact of a hand of a user with portions of the top plate 2 positioned over any of the first detection part 15*a*, the second detection part 16*a*, and the third detection part 17*a* can be detected on basis of changes by a specified value in capacitances of any of the first detection part 15*a*, the second detection part 16*a*, and the third detection part 17*a* in a shorter period in comparison with the changes caused by boil over. As described above, the provision of the plurality of first, second and third detection parts 15*a*, 16*a* and 17*a* makes it possible to identify conditions other than boil over when changes occur in the capacitances of the first detection part 15*a*, the second detection part 16*a*, and the third detection part 17*a* and thus makes it possible to accurately determine presence or absence of boil over, so that prevention of unnecessary reduction in the heating output and of stoppage of the heating operation and improvement in the ease of use of the cooking device can be attained.

Although the present invention has been fully described in connection with the preferred embodiments thereof with reference to the accompanying drawings, it is to be noted that various changes and modifications are apparent to those skilled in the art. Such Changes and modifications are to be understood as included within the scope of the present invention as defined by the appended claims unless they depart therefrom.

The disclosure of specifications, drawings, and claims of Japanese patent applications No. 2010-018168, No. 2010-018170, No. 2010-018171, No. 2010-018172, and No. 2010-018173 filed on Jan. 29, 2010 is incorporated herein by reference in its entirety.

INDUSTRIAL APPLICABILITY

The invention can be applied without limitation to induction heating cooking device of installation type shown in FIG. 1 because of capability thereof of detecting the liquid boiled over from the container to neighborhood in various directions, low frequency of misdetection and high reliability. For instance, the invention can be applied to cooking devices having gas burners or electrical heating elements other than induction heating type as heating sources or incorporated type cooking devices incorporated integrally in a built-in kitchen.

The invention claimed is:

1. A cooking device comprising:

a top plate on which a container is to be placed;

a heating device provided under the top plate;

a plurality of electrodes provided on a lower surface of the top plate;

a capacitance detection device for detecting changes in capacitance of the electrodes; and a boil over determination device for determining that liquid is boiled over from the container on the basis of the changes in capacitance detected by the capacitance detection device in heating operation of the heating device, wherein the plurality of electrodes include a plurality of separate arc-shaped detection parts provided along a periphery of the heating device, the arc-shaped detection parts being spaced-apart from each other on a circumference of a circle.

2. The cooking device according to claim 1, wherein the plurality of arc-shaped detection parts are positioned on a circumference of one circle having a center that generally coincides with a center of the heating device as seen looking from above.

3. The cooking device according to claim 2, wherein at least one arc-shaped detection part is provided on each of a front side and a rear side of a parallel direction center line that extends in parallel with a front face of the cooking device and that passes through the center of the heating device.

4. The cooking device according to claim 2, comprising a first arc-shaped detection part provided on the front side of the parallel direction center line, a second arc-shaped detection part provided on the rear side of the parallel direction center line, and a third arc-shaped detection part provided so as to intersect with the parallel direction center line.

5. The cooking device according to claim 4, comprising a plurality of heating devices, wherein the third detection part provided for each of the heating devices is provided on only a side nearer to the other heating device.

6. The cooking device according to claim 1, comprising a heating device control system that stops a heating operation of the heating device or reduces heating output of the heating device once the boil over determination device determines that the liquid is boiled over from the container.

* * * * *

UNITED STATES PATENT AND TRADEMARK OFFICE

CERTIFICATE OF CORRECTION

PATENT NO. : 8,723,083 B2
APPLICATION NO. : 13/394280
DATED : May 13, 2014
INVENTOR(S) : Kohei Kawata et al.

It is certified that error appears in the above-identified patent and that said Letters Patent is hereby corrected as shown below:

On the Title Page, Item (56)

Page 2, under "OTHER PUBLICATIONS", insert --Office Action and Search Report, and partial English Translation thereof, in corresponding Chinese Application No. 201180003697.2, dated July 2, 2013, 8 pages.--.

Signed and Sealed this
Sixth Day of January, 2015

Michelle K. Lee

Michelle K. Lee
*Deputy Director of the United States Patent and Trademark Office*